US010933419B2

(12) United States Patent
Kelly et al.

(10) Patent No.: US 10,933,419 B2
(45) Date of Patent: Mar. 2, 2021

(54) SAMPLE AND REAGENT RESERVOIR KITS AND LINERS WITH ANTI-VACUUM FEATURE

(71) Applicant: Integra Biosciences AG, Zizers (CH)

(72) Inventors: Terrence Kelly, Lowell, MA (US); Jonathan Harkins, Bedford, NH (US); George Kalmakis, Gloucester, MA (US); Gary Nelson, Hollis, NH (US)

(73) Assignee: Integra Biosciences AG, Zizers (CH)

( * ) Notice: Subject to any disclaimer, the term of this patent is extended or adjusted under 35 U.S.C. 154(b) by 323 days.

(21) Appl. No.: 16/002,567

(22) Filed: Jun. 7, 2018

(65) Prior Publication Data

US 2018/0353955 A1 Dec. 13, 2018

Related U.S. Application Data

(60) Provisional application No. 62/516,842, filed on Jun. 8, 2017.

(51) Int. Cl.
*B01L 3/00* (2006.01)
*B01L 3/02* (2006.01)

(52) U.S. Cl.
CPC ..... *B01L 3/5082* (2013.01); *B01L 3/505* (2013.01); *B01L 3/508* (2013.01); *B01L 3/50853* (2013.01); *B01L 3/502707* (2013.01); *B01L 3/021* (2013.01); *B01L 3/5027* (2013.01); *B01L 2200/16* (2013.01); *B01L 2300/028* (2013.01); *B01L 2300/042* (2013.01); *B01L 2300/0829* (2013.01); *B01L 2300/0832* (2013.01); *B01L 2300/0851* (2013.01); *B01L 2300/0858* (2013.01); *B01L 2300/16* (2013.01)

(58) Field of Classification Search
CPC .. B01L 3/5082; B01L 3/502707; B01L 3/505; B01L 3/508; B01L 3/50853
USPC ..... 422/552
See application file for complete search history.

(56) References Cited

U.S. PATENT DOCUMENTS 3,819,505 A * 6/1974 Parent ..... G01N 27/44756 422/430
4,774,057 A 9/1988 Uffenheimer et al.
5,837,203 A 11/1998 Godec et al.
6,027,695 A 2/2000 Oldenburg et al.
(Continued)

OTHER PUBLICATIONS

International Serach Report and Written Opinion dated Aug. 10, 2018 in co-pending PCT Application PCT/US18/36478.
(Continued)

*Primary Examiner* — Benjamin R Whatley
*Assistant Examiner* — Jacqueline Brazin
(74) *Attorney, Agent, or Firm* — Andrus Intellectual Property Law

(57) ABSTRACT

A pipetting reservoir kit includes a base, a disposable liner, and a lid. The disposable liner includes anti-vacuum channels on the bottom wall to prevent a pipette tip vacuum engaging the wall during aspiration. The groupings of anti-vacuum channels located on the bottom surface of the liner face upward into the basin that holds liquid samples or reagents. The groupings of anti-vacuum channels are spaced in an array 4.5 mm apart for a 384 pipetting head and 9 mm apart for a 96 pipetting head. The anti-vacuum channels also lower the required working volume for the liner and reduce liquid waste.

19 Claims, 10 Drawing Sheets

(56) References Cited

U.S. PATENT DOCUMENTS

| | | | | |
|---|---|---|---|---|
| 7,217,397 | B1 * | 5/2007 | Astle | B01L 3/50855 117/206 |
| 7,811,522 | B2 | 10/2010 | Mathus et al. | |
| 2002/0187079 | A1 * | 12/2002 | Ringleben | G01N 35/1065 422/562 |
| 2009/0008405 | A1 * | 1/2009 | Mathus | B01L 3/508 221/197 |
| 2009/0281250 | A1 * | 11/2009 | DeSimone | B29C 65/48 525/418 |
| 2011/0036862 | A1 | 2/2011 | Kanai et al. | |
| 2011/0186570 | A1 * | 8/2011 | Perry | B65D 51/24 220/23.87 |
| 2014/0272989 | A1 | 9/2014 | Knight | |
| 2015/0367341 | A1 * | 12/2015 | Zhou | B01L 3/502746 422/430 |
| 2016/0016170 | A1 * | 1/2016 | Lay | B01L 3/50273 204/601 |
| 2016/0354782 | A1 | 12/2016 | Zhou et al. | |

OTHER PUBLICATIONS

International Serach Report and Written Opinion dated Aug. 30, 2018 in co-pending PCT Application PCT/US18/36461.

* cited by examiner

SAMPLE AND REAGENT RESERVOIR KITS AND LINERS WITH ANTI-VACUUM FEATURE

FIELD OF THE INVENTION

The invention relates to clinical and research laboratory products, and in particular, laboratory reservoir kits and liners for liquid samples and reagents.

BACKGROUND OF THE INVENTION

Automated and semi-automated liquid handling systems often include pipetting heads for either 96 or 384 disposable pipette tips. A 96 pipetting head has an array of 8 by 12 tip mounting shafts with the centerline spacing between the adjacent shafts being 9 mm. A 384 pipetting head has an array of 16 by 24 mounting shafts with the centerline spacing between the adjacent shafts being 4.5 mm. The spacing is set by ANSI/SLAS Microplate standards (formerly known as SBS format). The American National Standards Institute/Society for Laboratory Automation and Screening (ANSI/SLAS) has adopted standardized dimensions for microplates:

ANSI/SLAS 1-2004: Microplates—Footprint Dimensions

ANSI/SLAS 2-2004: Microplates—Height Dimensions

ANSI/SLAS 3-2004: Microplates—Bottom Outside Flange Dimensions

ANSI/SLAS 4-2004: Microplates—Well Positions

ANSI/SLAS 6-2012: Microplates—Well Bottom Elevation

These standards have been developed to facilitate the use of automated liquid handling equipment with plastic consumable products from different manufacturers. Automated or semi-automated liquid handling systems having a matrix of fewer mounting shafts such as a 24 pipetting head or more mounting shafts such as a 1536 pipetting head are also used in the field, although the most common are the 96 and 384 heads. These automated or semi-automated liquid handling systems are typically designed with platforms located underneath the pipetting head, which contain one or more nesting locations for microplates, racks of microtubes or reservoirs for holding samples or reagents. In the art, microplates are sometimes referred to as well plates, and microtubes are sometimes referred to a sample tubes. The nests are sized in accordance with the outside dimensions for microplates for the SBS standard (now ANSI/SLAS) in order to align each of the 96 or 384 pipette tips with the center points of the respective wells in the microplate on the platform.

As mentioned, laboratory reservoirs for holding samples or reagents can also be placed on the platform in the nest. Reservoirs typically have a common basin instead of individual wells and are known to have either a flat bottom or a patterned bottom in order to reduce liquid hang-up. It is also known to use a disposable reservoir liner to avoid the need to clean and/or sterilize reservoirs before starting a new procedure. Many reservoirs and liners are made of polystyrene which is naturally hydrophobic. The hydrophobic surface causes liquid to bead up during final aspiration which is generally thought to facilitate liquid pick up and reduce the residual volume.

One problem that has been found to occur with the use of disposable reservoir liners on automated or semi-automated 96 or 384 head systems is that one or more of the mounted pipette tips may engage the surface of the liner bottom when the pipette head is lowered. A pipette tip engaged with the surface of the liner bottom can unfortunately create a vacuum within the tip when the head aspirates and can draw the liner tight against the orifice at the bottom of the tip. The vacuum within the tip increases as aspiration continues and the orifice is eventually closed off. This situation can lead to inaccurate pipetting, but can also lead to contamination of the pipetting head which is a serious issue. When a pipette tip that has vacuum engaged the liner bottom releases, the reagent or sample, now driven by a significant pressure difference, often sprays upward beyond the pipette tip and the mounting shaft into the respective piston cylinder. If this occurs, it may be necessary to disassemble, clean and sterilize the entire pipette head.

It is often desirable to reduce residual volume or liquid hang-up in the liner when attempting to fully aspirate all the liquid from the liner. To this end, pipette tips are typically lowered as close to the bottom wall of the liner without contacting the bottom wall as reasonably possible in order to reduce the residual volume of liquid that cannot be aspirated. In multi-channel pipetting systems, even automated multi-channel systems where the height of the pipetting head can be controlled precisely, one or more pipette tip orifices can become misaligned with the other tip orifices because, for example, a pipette tip is mismounted or deformed. Tip misalignment can lead to the tip engaging the bottom wall and forming a vacuum. Even if all of the pipette tips are aligned properly, it is possible that the portions of the bottom wall in the liner corresponding to the locations of the pipette tips are not precisely aligned on a plane level with the pipette tip orifices. This sort of unevenness can occur, e.g., when a liner is not fully seated in a reservoir base or is slightly deformed, and can also lead to one or more pipette tips engaging the bottom wall when trying to aspirate the final volume from the container.

SUMMARY OF THE INVENTION

The invention relates primarily to the placement of anti-vacuum channels on the bottom wall of a disposable reservoir liner used in laboratory reservoir kits.

In one aspect, the invention is directed to features of the disposable liner. In another aspect, the invention is directed to features of the kits including a disposable liner that is held within a reusable reservoir base. The disposable liner and the reusable reservoir base are designed so that the liner fits into the base and provides stable support for the liner with the bottom wall of the liner sitting on the reservoir base. The disposable liner is especially configured to prevent pipette tips from vacuum engaging the bottom wall of the liner basin. To do this, an upper surface of the bottom wall of the liner basin includes multiple anti-vacuum channels that face upwardly towards the volume in which the liquid sample or liquid reagent is held. The bottom wall has a generally rectangular shape configured to enable a matrix of pipette tips to aspirate liquid from the volume in the liner basin. The purpose of the anti-vacuum channels is to provide a fluid accessible void underneath the orifice of the pipette tip even when the tip is pressed against the upper surface of the bottom wall of the liner. It has been found that using the anti-vacuum channels and keeping the bottom wall of the liner straight or flat also generally reduces the residual volume of liquid remaining in the liner when it is attempted to fully aspirate liquid from the liner with a 96 or 384 tip pipetting head, compared to liners without the anti-vacuum channels.

In one embodiment, the liners are made of molded polystyrene which is generally considered to be hydrophobic as discussed above. However, it has been found that corona treating the polystyrene liners with the anti-vacuum channels, in order to render the bottom wall more hydrophilic, further reduces the residual volume remaining in the liner when it is attempted to fully aspirate liquid with a 96 or 384 tip pipetting head. It is preferred that the corona treatment be sufficient to render the measured surface tension of the bottom wall of the liner greater than or equal to about 72 dynes, which is the surface tension for natural water. In another embodiment, the liner is made from molded polypropylene. This embodiment is particularly useful for applications where chemical resistance is more important. Polystyrene is stiffer than polypropylene, however, which is often beneficial in the laboratory.

Desirably, the reusable reservoir base has outside flange dimensions compatible with nests configured to hold SBS-formatted well plates and reservoirs (i.e. ANSI/SLAS 3-2004: Microplates—Bottom Outside Flange Dimensions). If the reservoir is made to be used with a 96 pipetting head, the disposable liner contains a matrix of 96 groupings of anti-vacuum channels with a center point for each grouping spaced 9 mm from the center point of adjacent groupings, consistent with SBS (ANSI/SLAS) formats. If the disposable liner is designed to be used with a 384 pipetting head, the liner desirably contains a matrix of 384 groupings of anti-vacuum channels with the center point for each grouping spaced 4.5 mm from the center point of adjacent groupings, again consistent with SBS (ANSI/SLAS) formats. The disposable liner can also be made with more or less groupings depending on the intended use of the liner; however, in each case the groupings should be centered at the center point at which it is expected that the pipette tips on the pipetting head will be located. In some embodiments, the liner contains a matrix of 96 groupings of anti-vacuum channels with adjacent center points spaced 9 mm apart, as well as a matrix of 384 groupings of anti-vacuum channels having center points spaced apart 4.5 mm. In this manner, the liner is configured to be used both with a 96 pipetting head or a 384 pipetting head.

The groupings of the anti-vacuum channels can take on various configurations in accordance with the invention. The goal is to provide a channel configuration that will provide a fluid accessible void underneath the orifice of the respective pipette tip even if the pipette tip is somewhat off center, which can occur in an automated pipetting system, for example, when a pipette tip is not mounted straight or the tip is slightly deformed. One desired grouping configuration includes a first pair of perpendicular and intersecting channels with the intersection of the channels defining a center point for the grouping, and a second pair of perpendicular channels rotated 45° from the first pair where the second pair of channels are aligned to intersect at the center point but are interrupted in the vicinity of the center point. It is desirable that the channels have a constant width (except for necessary draft angles required for reliable molding) and a constant depth, and that the width of the channels is selected so that the distance across the intersection is less than the outside orifice diameter of the smallest sized pipette tips that will likely be used with that liner. For example, if a 12.5 μl pipette tip has an outside orifice diameter of 0.61 mm, then the width of the channels should be less than or equal to about 0.50 mm to ensure that the distal end of the pipette tip cannot fit into the channels at the intersection. For a 384 application, the desired channel width using the above described grouping configuration is 0.50 mm+/−0.10 mm. For a 96 head application, the desired width is 0.50 mm+/−0.10 mm as well. The grouping may also have other channels located away from the center point towards the perimeter of the grouping in order to provide a larger region covered by anti-vacuum voids in the event that the pipette tip orifice is off center because of how the tip is mounted or constructed, or in the event it is used with a hand-held pipette. Providing a bigger area of coverage by the channels over the bottom wall, also creates a higher likelihood that peripheral liquid will be drawn into the channels of the grouping when liquid is being drawn by a pipette tip, which in turn tends to reduce the dead volume or residual volume, other factors being equal. In one embodiment, a circular channel intersects each of the first and second pair of channels.

In some embodiments, additional channels are located between adjacent groupings to fluid dynamically connect adjacent groupings of anti-vacuum channels. In other embodiments, such as those shown in the Figures, no channels extend between adjacent groupings of anti-vacuum channels.

In the disclosed embodiments, the bottom wall of the disposable liner is otherwise flat, and the groupings of anti-vacuum channels are located at the center point for either a 96 pipetting head or a 384 pipetting head configuration or both. The disposable liner desirably is made of a transparent plastic material, such as clear molded polystyrene or polypropylene as mentioned above, and has a shape that closely follows the contour of the basin of the reusable base, in part to facilitate viewing of liquid volume graduation marks on the side walls of the base. Also desirably, the side walls of the reusable reservoir base have distinct liquid volume graduation marks on the surface of the side wall forming a portion of the basin. These liquid volume graduation marks are calibrated to measure a volume of liquid sample contained in the transparent disposable liner and are observable when the disposable liner is set in place within the reusable base. Further, one or more sides of the reusable base may contain one or more viewing windows so that a user can easily view the amount of liquid contained in the disposable liner. The viewing window can be a narrow window or it can be relatively wide as long as the base still has enough support for the disposable liner.

In some embodiments, the laboratory reservoir kit includes a lid to cover liquid contained in a liner placed within the reusable base. It is preferred that the lid be transparent to facilitate viewing of contained liquid or reagent when the lid is latched in place. A gasket is provided optionally on the lid, and a locking mechanism on the reservoir base is used to lock the lid in place and secure the liner between the gasket on the lid and the base to seal the contained liquid. The lid is also preferably configured to facilitate stacking of kits with the lid attached. The locking mechanism can also be used to hold the liner in place during use when the lid is removed.

Advantageously, the use of anti-vacuum channels on the bottom wall of the disposable liner provides a fluid accessible void even if a pipette tip engages the bottom wall of the liner. This means that the pipette tip will not cause a vacuum within the tip while the pipette is aspirating. It also means that, as a practical matter, tips can be placed closer to the bottom wall of the liner and/or engage the bottom wall of the liner when doing so without the anti-vacuum feature would more likely cause vacuum engagement. In turn, with the ability to move the pipette tip orifice very close to or into engagement with the bottom wall of the liner, the pipetting system is able to withdraw liquid from the container with significantly less residual volume. In addition, without being limited to a theory of operation, it is believed that the hydrophilic nature of the corona treated surface causes liquid on the surface to self level, while the channels provide surface tension features that accumulate liquid on the surface. The result is that the liquid draws naturally from the surface between the groupings of channels and forms segregated pools in and above the groupings of channels, as the liquid level is drawn down. This phenomenon effectively lowers the minimum working volume for reliable pipetting. This is particularly important for expensive, scarce or small samples or reagents.

Other features and advantages of the invention may be apparent to those skilled in the art upon reviewing the drawings and the following description thereof.

DETAILED DESCRIPTION

Figure 1:
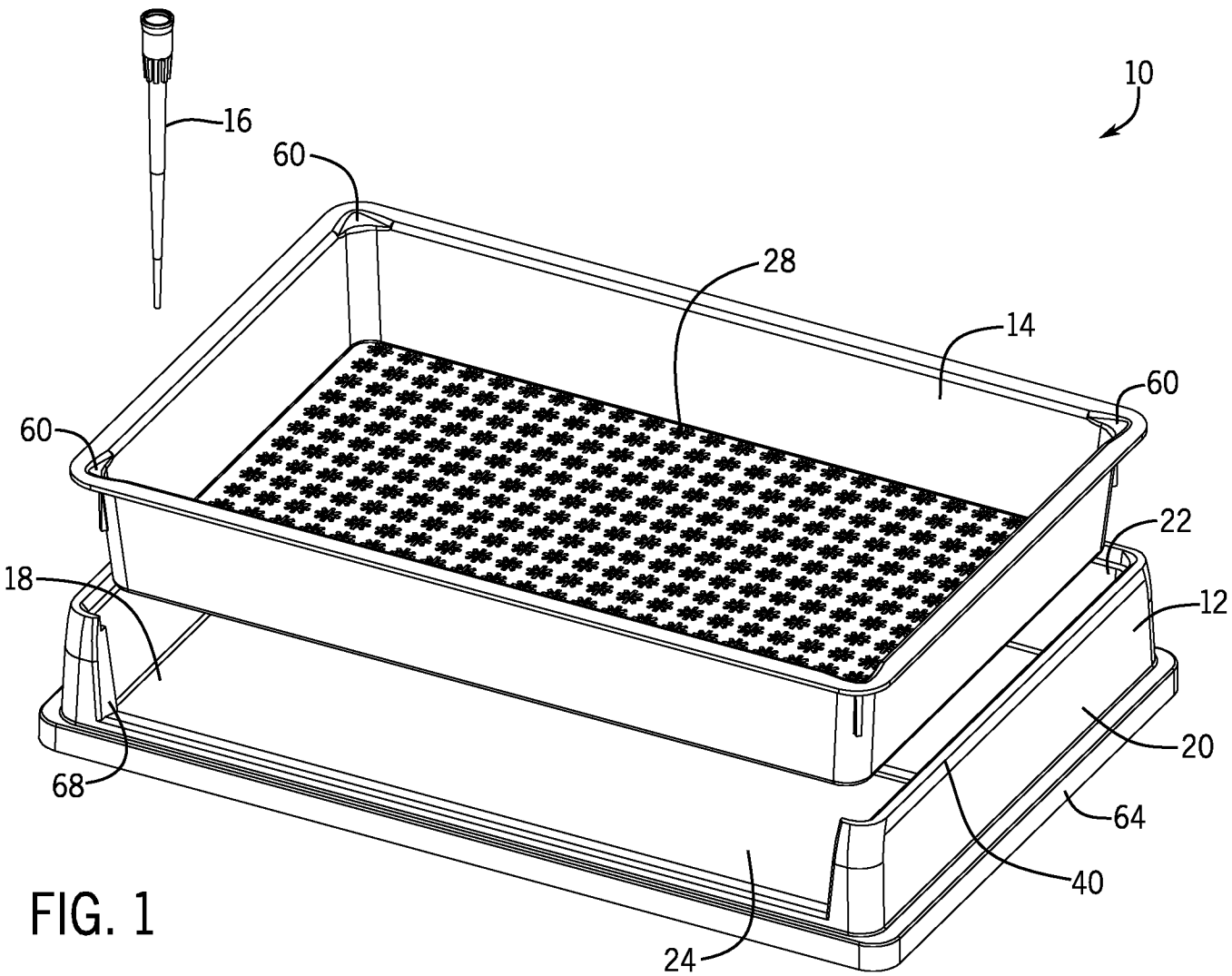
FIG. 1 is a laboratory reservoir kit constructed in accordance with a first exemplary embodiment of the invention, which is configured for a 384 pipetting head.

FIGS. 1 through 8 illustrate a laboratory reservoir kit 10 for liquid samples and reagents constructed in accordance with the first embodiment of the invention. The kit 10 includes a reservoir base 12 and a disposable liner 14. FIGS. 1 through 8 also show an exemplary pipette tip 16. The kit 10 is designed to hold liquid sample or liquid reagent in the disposable liner 14 when the disposable liner 14 is placed within the reusable reservoir base 12 as shown for example in FIG. 2. The kit 10 is designed to hold up to 100 ml of liquid sample or reagent although the capacity of the disposable liner 14 is sufficient to handle substantial overfilling. As mentioned previously, the use of a low retention pipette tip 16 may be particularly effective when using the reservoir kit 10 in order to minimize waste of scarce or expensive liquid samples or reagents.

The reservoir base 12 contains a basin 18 into which the disposable liner 14 is placed. The contour of the disposable liner 14 closely follows the shape and contour of the basin 18 of the reusable base 12. Outer side walls 22 and end walls 20 on the reusable base 12 provide support for the reservoir base 12 and its basin 18 on flat surfaces such as a laboratory bench top. While the reservoir base 12 can be made of a variety of materials, it is preferred that the base 12 be made of relatively rigid injection molded plastic having an opaque color such as white ABS. It is preferred that the surface of the basin 18 have a satin finish. On the other hand, as mentioned above, it is preferred that the disposable liner 14 be made of clear transparent plastic and have a polished surface (at least the sidewalls and peripheral flange), such as clear injection molded polystyrene or polypropylene having a thickness of approximately 0.51 mm. The polished or shiny surface of the clear liner, in contrast to the satin finish on the opaque color basin 18 in the base 12, renders the transparent liner 14 more conspicuous to laboratory workers trying to determine whether or not it is present within the reservoir base 12. Injection molding is the preferred method to manufacture the disposable liner 14 because it is desirable for the liner thickness to be constant throughout. It should be recognized, however, that other manufacturing methods and thickness specifications may be possible for both the disposable liner 14 and the reusable base 12.

When the disposable liner 14 is made of molded polystyrene or polypropylene, e.g., it is desirable to corona treat or otherwise treat the liner after molding in order to render s the plastic surface more hydrophilic, which means that small amounts of liquid remaining in the liner tend to flatten out on the surface of the bottom wall rather than bead up. However, the capillary action of the channels tends to draw the liquid into pools above the channel groupings as the liquid is drawn down. It is generally believed in the art that providing a hydrophobic surface, so that small amounts of liquid tend to bead up, would normally be the best way to reduce the amount of residual volume after pipetting from a reservoir or a reservoir liner. With the use of anti-vacuum channels as described herein, the inventors have found it advantageous to corona treat the surface rendering it more wettable and hydrophilic, thereby providing a surface on which the liquid tends to spread evenly, with the capillary action of the channels being responsible for creating pools or beads of liquid suitable for effective pipetting at the final draw down. With the anti-vacuum channels and the fluid accessible voids underneath the pipette tip orifices, even if tips are engaging the bottom surface of the liner, the hydrophilic surface facilitates more even fluid distribution available for aspiration from multiple pipette tips and less residual volume after complete aspiration of liquid from the container. As mentioned, it is desirable to treat the surface so that its surface tension is greater than or equal to 72 dynes, which is the surface tension for natural water.

The disposable liner 14 can be made of polypropylene for applications in which chemical resistance is desired. The polypropylene liner should likewise be corona treated or otherwise treated so that its surface tension is greater than or equal to the surface tension of water, 72 dynes.

The basin 18 in the reusable base 12 is rectangular and extends between the bottom of the end walls 20 and the side walls 22. The rectangular basin is compatible with the SBS format and is sized for a 384 pipetting head or a 96 pipetting head. The disposable liner 14 shown in FIGS. 1 through 8 is designed for a 384 pipetting head, although the rectangular footprint of the basin 18 in the reusable base 12 should be the same whether the disposable liner 14 is designed for a 384 pipetting head or a 96 pipetting head. The bottom wall 24 of the basin 18 in the reusable base 12 is flat. Referring to FIG. 5, the disposable liner 14 is configured to fit in the base 12 so that the bottom wall 24, the end walls 20 and the longitudinal side walls 22 (see FIG. 1) of the base 12 support the disposable liner 14 with the bottom wall 26 of the liner 14 sitting on the bottom wall 24 of the reservoir base 12. As can be seen in FIG. 5 as well as the other drawings, the bottom wall 26 of the disposable liner 14 in this embodiment is flat.

Figure 2:
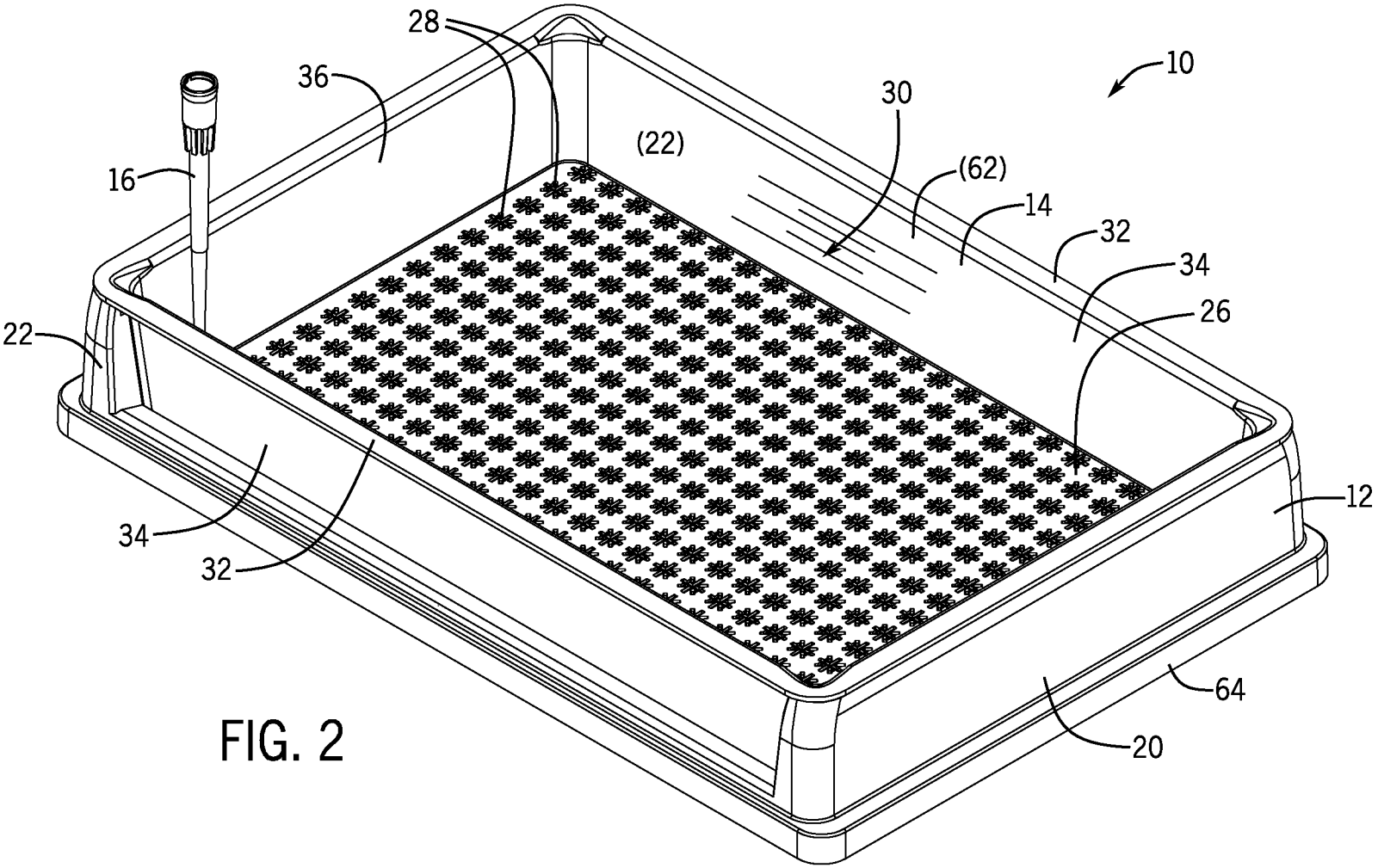
FIG. 2 is an assembled view of the kit shown in FIG. 1.
Figure 3:
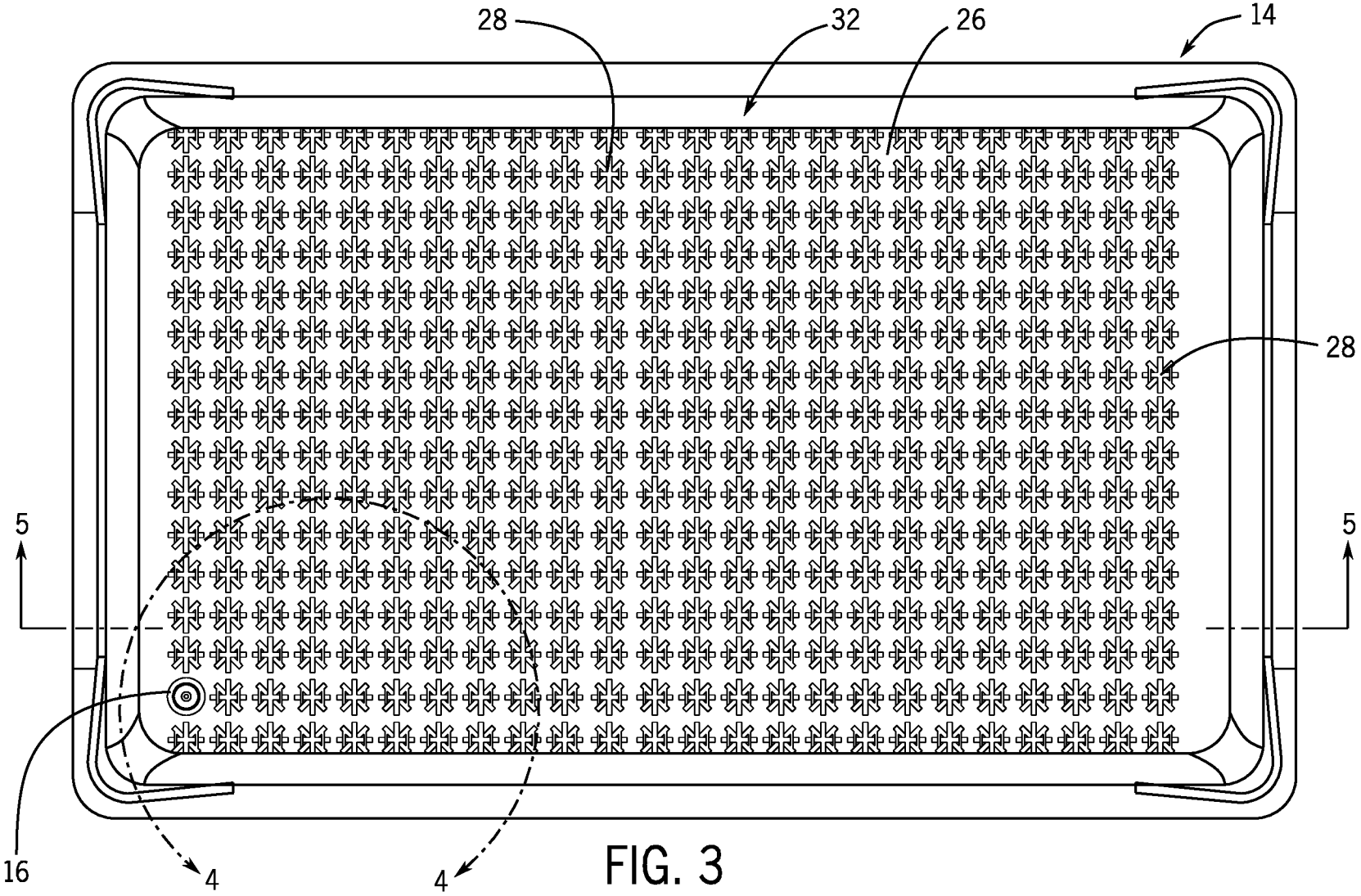
FIG. 3 is a top plan view of the laboratory reservoir kit shown in FIG. 2. The placement of the channel groupings in FIGS. 1-3 is illustrative of the placement of the channel groupings in a reservoir configured for a 384 pipetting head, but reference to FIG. 4 should be made for the configuration of the channels in the groupings.
Figure 4:
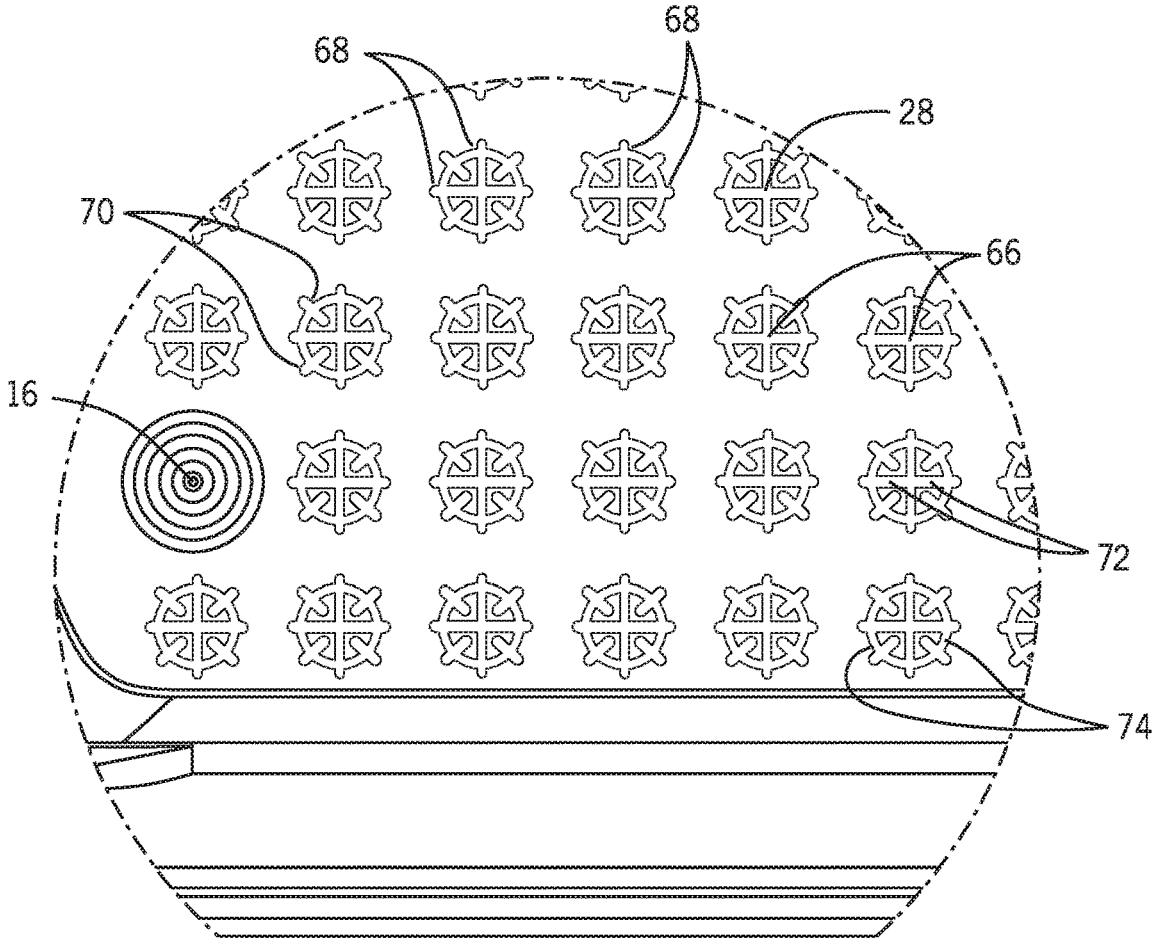
FIG. 4 is a detailed view showing the configuration of the channels in the channel groupings of a reservoir configured for a 384 pipetting head.
Figure 5:
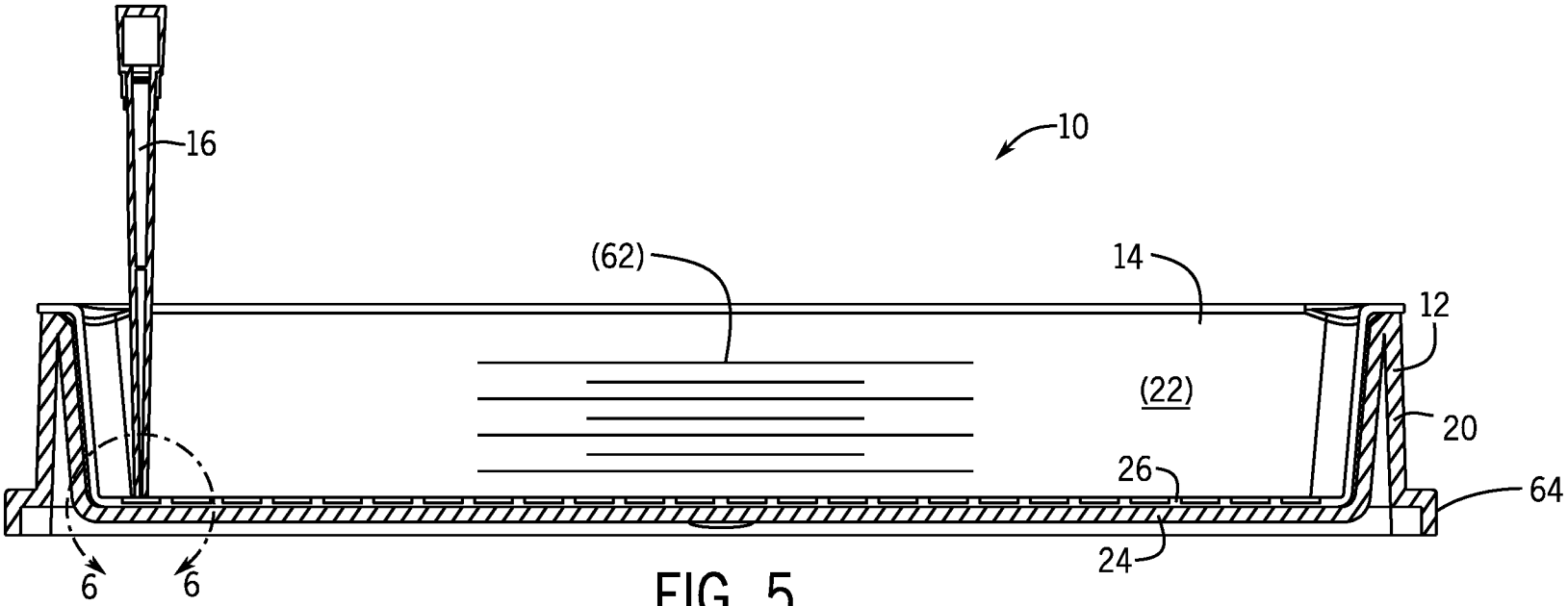
FIG. 5 is a schematic sectional view showing a pipette tip engaging the bottom wall of the reservoir with a channel below the tip orifice.

Referring to FIGS. 2 through 4, the bottom wall 26 of the disposable liner 14 includes a matrix of 384 groupings of anti-vacuum channels 28. The anti-vacuum channels 28 are exposed upwardly towards the volume 30 in which liquid sample or liquid reagent is held in the disposable liner 14. The bottom wall 26 of the liner 14 has a generally rectangular shape configured to enable the entire matrix of 384 pipette tips arranged in SBS format to aspirate liquid sample or liquid reagent from the disposable liner 14. The disposable liner 14 includes a peripheral flange 32 that extends outwardly from an upper end of the liner side walls 34 and end walls 36. The peripheral flange 32 on the disposable liner 14 may rest or touch slightly on the upper rim 40, see FIG. 1, of the base 12 when the disposable liner 14 is placed within the base; however, the bottom wall 26 of the disposable liner 14 should rest on the bottom wall 24 of the reusable base 12. The peripheral flange 32 helps to secure the disposable liner 14 within the base 12, and also facilitates lifting of the disposable liner 14 by laboratory workers. It is advised that the user lift the disposable liner 14 from the reusable base 12 to the position shown for example in FIG. 1 before pouring liquid from the liner 14. In order to facilitate such pouring, the disposable liner 14 includes pouring spouts 60 at each corner. The front side wall 22 of the base 12 includes a cut out region 69 which serves as a window so that the user can easily see the liner 14 when it sits in the base 12. Although not necessarily preferred, a transparent insert can be placed across the window 69.

Figure 7:
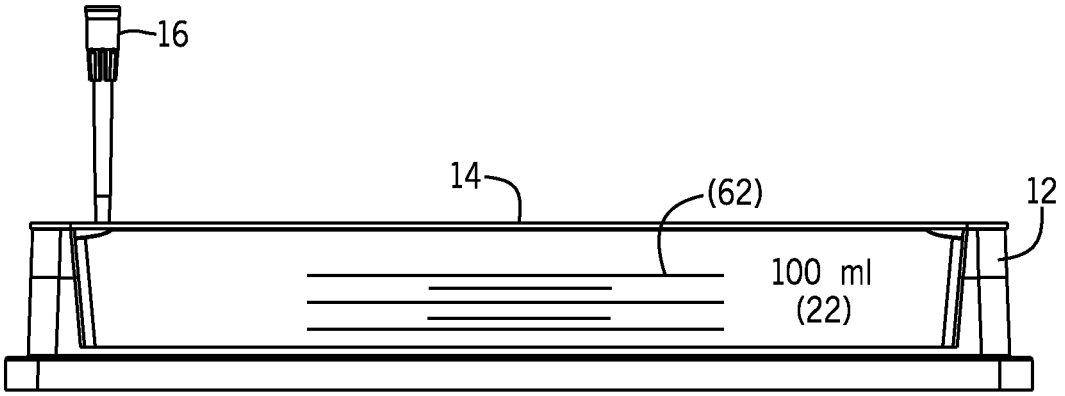
FIG. 7 is a side elevational view of the laboratory reservoir kit shown in FIGS. 1 through 6.
Figure 8:
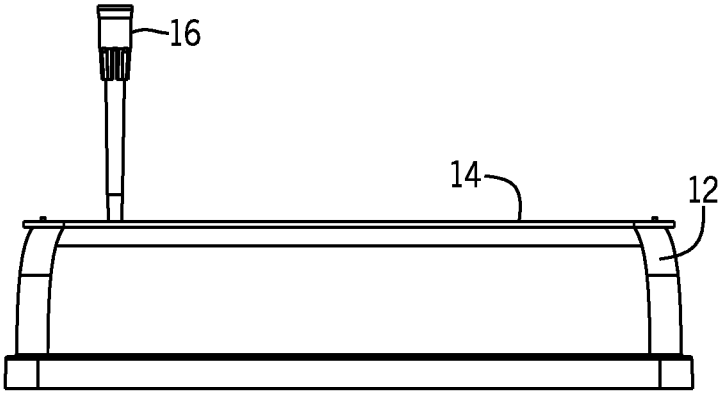
FIG. 8 is an end elevational view of the laboratory reservoir kit shown in FIGS. 1 through 7.

Liquid volume graduation marks (62), see FIGS. 2, 5 and 7, are molded or printed onto the side wall 22 of the reusable base 12. The liquid volume graduation marks (62) are preferably printed onto the side wall 22 using pad printing or any other suitable process. The liquid volume graduation marks (62) on the side wall can be seen by the user through the clear, transparent liner 14 when the liner 14 is placed in the base 12. FIGS. 2, 5 and 7 show the liner 14 placed in the base 12, and illustrate that the liquid volume graduation marks (62) on the side wall 22 of the base 12 can be viewed through the transparent disposable liner 14. In FIGS. 2, 5 and 7 the reference number (62) for the liquid graduation marks has been placed in parenthesis to indicate that the marks on the opaque surface of the base 12 underlies the clear transparent liner 14. Likewise, reference number (22) is placed in parentheses to indicate that the side wall of the base 12 underlies the transparent liner 14 in these figures as well. Volume indicators may also be printed on the side wall (22) of the base 12. While the values for the volume indicators are not illustrated per se in the drawing, a 100 ml kit 10 would typically include values of 20, 40, 60, 80 and 100 adjacent the associated volume liquid graduation mark. Since the kit 10 is intended to be used with the disposable liner 14 set in place within the base 12, the location of the graduation marks (62) is calibrated with respect to the volume of liquid contained within the disposable liner 14 when the disposable liner is in place, not with respect to the volume of the basin of the base 12. It is desired that the volume indicators on the basin side wall (22) of the base 12 be printed at or above the calibrated liquid volume graduation marks (62) to which they are associated, so that liquid within the liner does not obstruct reading of the respective volume indicator.

Referring again to FIG. 1, the bottom flange 64 on the base 12 has outside wall dimensions compatible with SBS standards (namely ANSI/SLAS 3-2004: Microplates—Bottom Outside Flange Dimensions). Having SBS compatible outside wall dimensions means that the base 12 will fit into platform nests for liquid handling systems having a 96 or 384 pipetting head, and be in alignment so that each of the pipette tips aligns at least generally with one of the groupings of anti-vacuum channels 28. Referring now to FIG. 4, it is desired that each grouping of anti-vacuum channels 28 have a similar configuration for a given liner. However, it is possible that one or more of the groupings of anti-vacuum channels have a different configuration than the other groupings of the anti-vacuum channels on the liner. Referring to the groupings identified by reference number 28 in FIG. 4, each grouping of anti-vacuum channels has a center point 66, and since the liner 14 shown in FIGS. 1 through 8 is for a 384 pipetting head, the spacing between adjacent center points 66 is 4.5 mm in accordance with SBS standards. By way of example, FIG. 4 shows a pipette tip 16 aligned with the centerpoint 66 of one of the groupings of anti-vacuum channels. Each grouping 28 contains a first pair of perpendicular intersecting channels 68 with the intersection 66 defining the center point for the grouping 28. In FIG. 4, the first pair of perpendicular and intersecting channels 68 are the vertical channel 68 and the horizontal channel 68 (as viewed in FIG. 4). The grouping 28 also includes a second pair of perpendicular channels 70 that are rotated 45° from the first pair 68 of channels. The channels in the second pair 70 are aligned to intersect at the center point 66 but are interrupted in the vicinity of the center point 66. Therefore, an irregularly shaped pedestal 72 at the height of the upper surface of the bottom wall 26 is formed between the channels 68 and 70. Allowing the second pair of channels 70 to continue through the center point 66 would create an air space around the center point 66 having too great of a diameter to obstruct continued downward movement of the lower distal end of the smallest sized pipette tip that the disposable liner 14 is designed to be used with. For example, a 12.5 μl pipette tip may have a lower orifice with an outside diameter of 0.61 mm and an inside diameter of 0.30 mm. The width and configuration of the channels 68, 70 should be selected so that there are no channel areas in which the 0.61 mm orifice can fit down into. The channel configuration should also be designed so that at least a portion of the orifice opening having an inside diameter of 0.30 mm spans over an open channel even if the tip is pressed down against the liner 14 at or near the center point 66. In the exemplary embodiment, for the channel grouping 28 shown in FIGS. 4 and 5 for a 384 pipetting head, the channels 68, 70 have a generally constant width of 0.50 mm±0.10 mm, although a draft angle for molding must be accounted for. It is also desirable that for the depth of the channels 68, 70 be constant, e.g. 0.30 mm±0.10 mm. In FIG. 4, the channel groupings 28 also include a circular channel 72 spanning between the first pair 68 and second pair 70 of channels. This circular channel 72 provides more tolerance for pipette tip misplacement.

Figure 6:
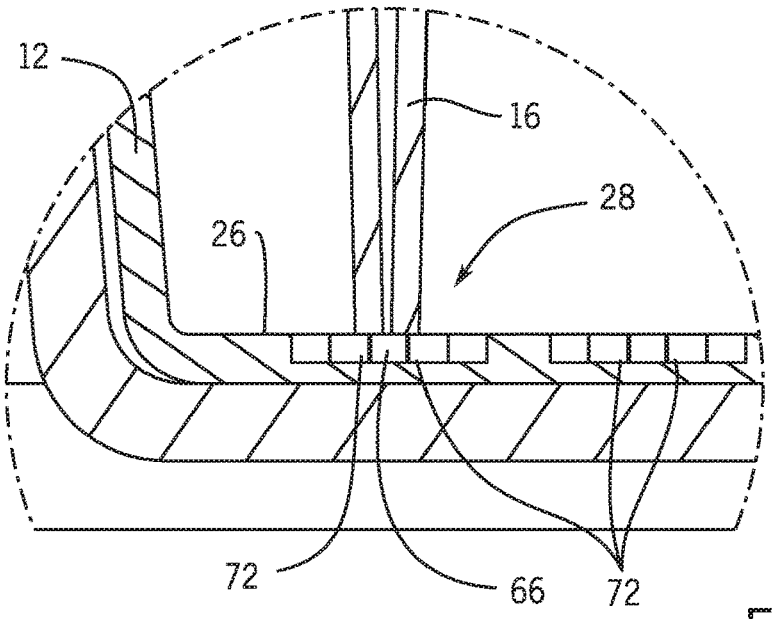
FIG. 6 is a detailed view of the region shown by line 6-6 in FIG. 5.

FIGS. 5 and 6 show the kit 10 in use with an exemplary pipette tip 16 pressing down on to the bottom wall 26 of the liner 12 with the pipette tip 16 aligned with a grouping of anti-vacuum channels 28. The bottom of the pipette tip 16 is pressing against pedestals 72 between the intersecting channels at the center point 66 of the grouping 28 and the third pair of channels 74, see FIG. 4. The inner orifice of the pipette tip 16 resides directly over the intersecting channels at the center point 66, even when the pipette tip 16 is pressed down against the bottom floor 26 of the liner 12. In this way, no vacuum is created when the pipette is operated to aspirate liquid into the pipette tip 16.

Figure 9:
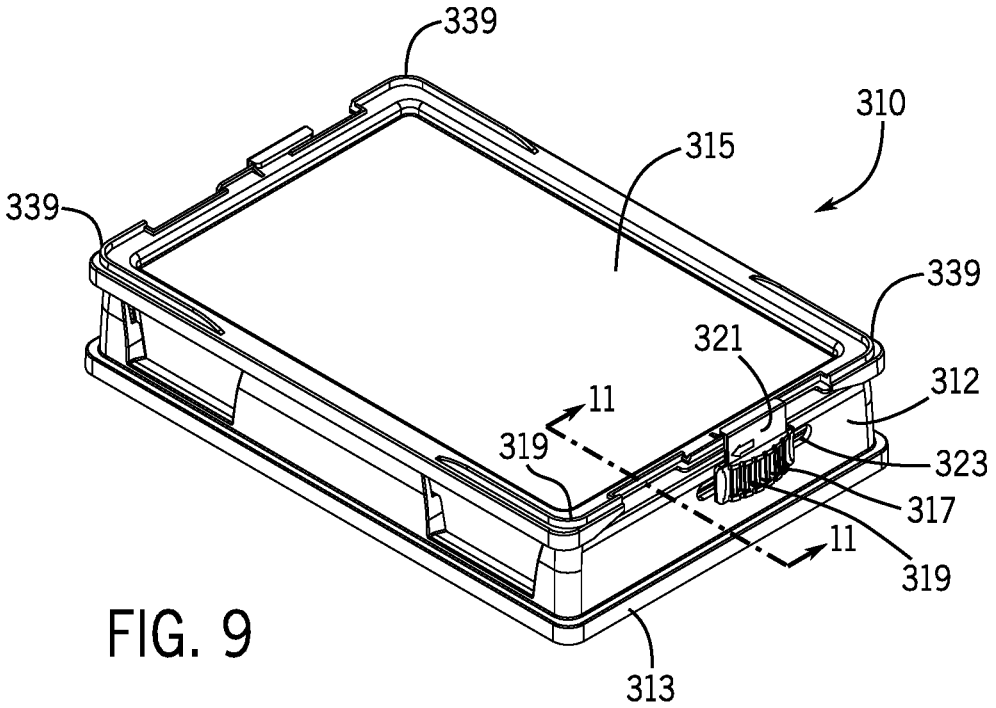
FIG. 9 is a laboratory reservoir kit constructed in accordance with another exemplary embodiment of the invention, which is configured to be used with either a 96 pipetting head or a 384 pipetting head, and shows the kit assembled with a lid secured to the kit.
Figure 10:
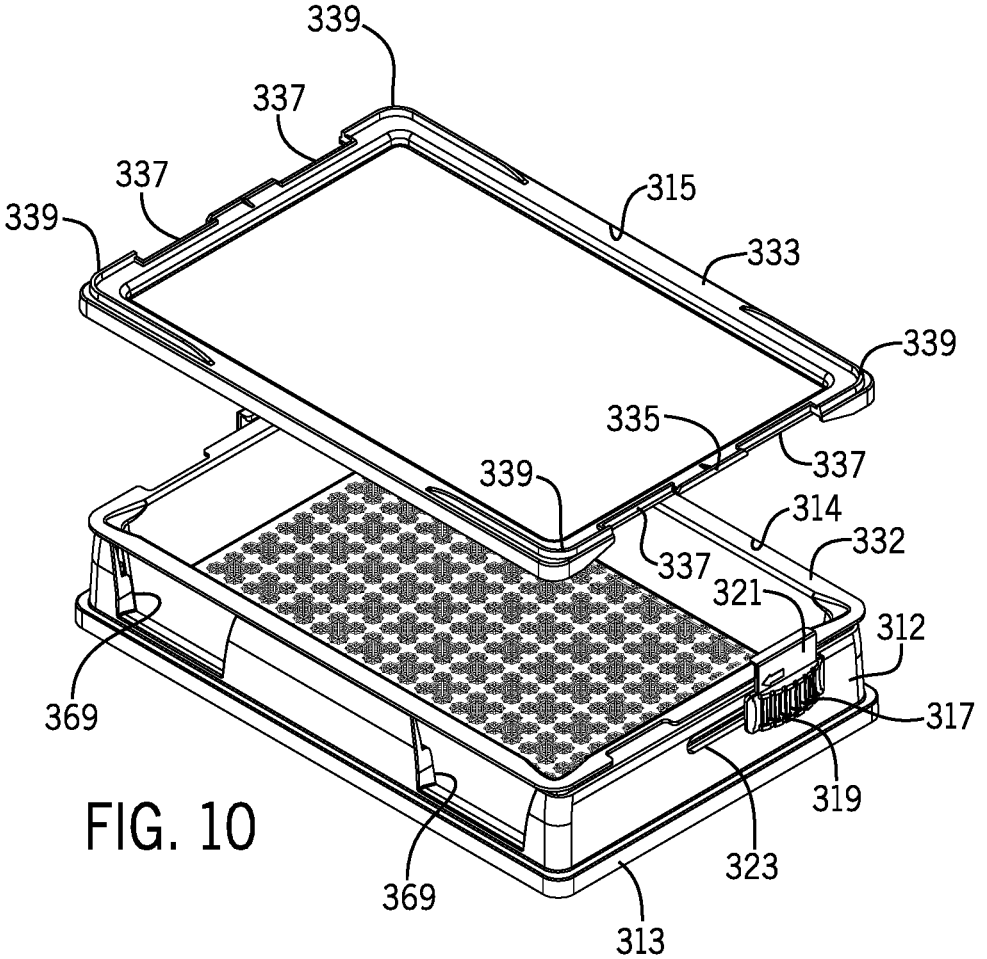
FIG. 10 is perspective view of the laboratory reservoir kit shown in FIG. 9 with the lid exploded away from the remaining components of the kit.
Figure 11:
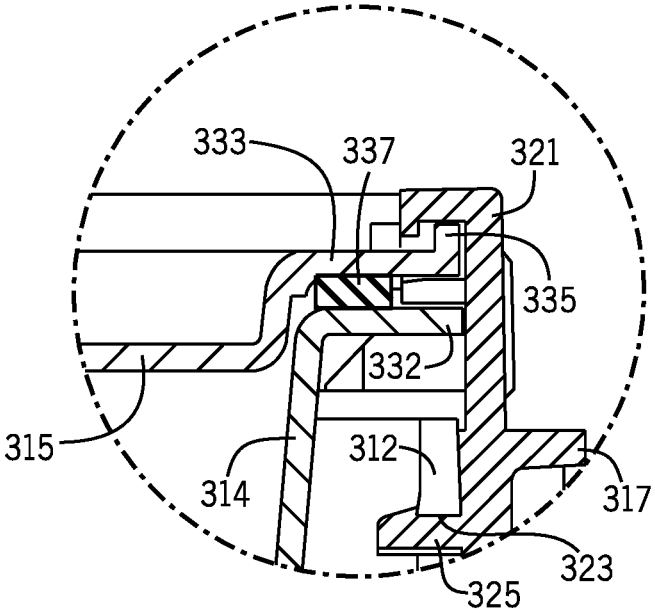
FIG. 11 is a detailed sectional view taken along line 11-11 in FIG. 9, showing the interaction of the locking mechanism to attach the lid to the kit.

FIGS. 9 through 15 illustrate a liquid reagent reservoir kit 310 constructed in accordance with another embodiment of the invention. The reservoir kit 310 includes a disposable liner 314 that is similar in many respects to the disposable liner 14 shown in FIGS. 1 through 8; however, the disposable line 314 is designed to be used with both a 96 pipetting head and a 384 pipetting head. Again, as apparent in the drawings, the bottom wall of the liner 314 is flat except for the anti-vacuum channels. The reservoir kit 310 has a reusable reservoir base 312 which in many respects is similar to the reusable base 12 shown in FIGS. 1 through 8. The reservoir kit 310 is designed to hold up to 150 mL of liquid but other sizes, such as 300 mL, can be made by increasing or decreasing the height of the sidewalls of the liner 314 and the base 312. The kit 310 also includes a lid 315 which is preferably transparent to enable the user to view liquid contained in the liner 314. Locking mechanisms 317 located on the base 312 are used to lock the lid 315 in place over the liner 314 and any contained liquid or reagent. FIGS. 9 through 15 generally illustrate one locking mechanism on one side of the kit 10, but it should be understood that another locking mechanism is located on the other side of the kit 10. The locking mechanism 317 includes a finger grip 319 and a latch arm 321 that is mounted through an elongated slot 323 in the side wall of the base 312. A sliding attachment arm 325 holds the locking mechanism 317 in the elongated slot 323 as shown in FIG. 11. The locking mechanism 317 can be slid from an unlocked position which is located to the right side of the elongated slot 323 in FIG. 10 to a locked position which is located to the left most position in elongated slot 323 as depicted by the arrow shown in FIG. 10 on the latch arm 321. In FIG. 9, the locking mechanism 317 is shown midway between the unlocked position and the locked position.

Figure 12:
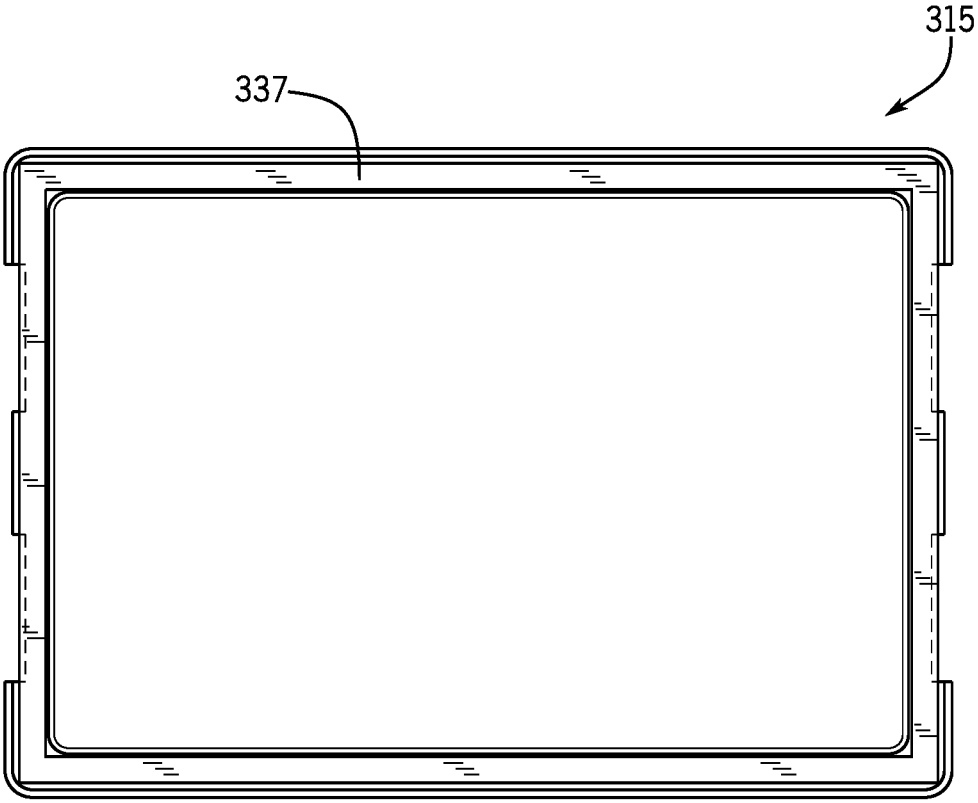
FIG. 12 is a bottom plan view of the lid shown in FIGS. 9 and 10 illustrating a peripheral sealing gasket.

FIG. 12 shows the underside of the lid 315. A gasket 337 or seal is located around the periphery of the lid 315. The gasket 337 is an optional feature. Referring to FIG. 11, the gasket 337 presses against the peripheral flange 332 of the liner 314 when the lid 315 is locked in place, thereby providing a circumferential seal around the top of the liner 314. The gasket 337 shown in the drawings has a flat cross section; however, other types of gaskets may be suitable. For example, using a gasket with a stepped cross section can provide more robust sealing. The stepped cross section not only enables the gasket to press against the peripheral flange 332 of the liner 314 when the lid 315 is locked in place but also press against liner at the intersection between the sidewall of the liner and the peripheral flange 332. When a gasket is used, the lid is preferably molded from polypropylene. The use of a gasket, however, is not desirable if the reservoir is intended to be removed robotically. For robotic applications, the lid is desirably made of polystyrene, which is stiffer than polypropylene, and without a gasket. Still referring to FIG. 11, the latch arm 321 extends upward and then inward to engage the upper rim 333 of the lid 315. The rim 333 includes an upwardly extending fastening lip 335 which facilitates reliable attachment of the lid 315 to the base 312 when the locking mechanism 317 is engaged in the locked position. Referring for example to FIG. 10, the peripheral rim 333 of the lid 315 has cutouts 338 corresponding to the unlocked position of the locking mechanism 317. The base 312 has a second sliding locking mechanism on the other end wall. Including four cutouts 338 as shown in the figures enables the lid to be placed in either direction. The lid 315 also includes guide ridges 339 on the top surface of the lid 315 to facilitate stable stacking of the kits 310 when, for example, liquid is stored in the liner 314 and the lid 315 is locked into place. The guide ridges are dimensioned to fit within the lower outer wall flange 339 of the base 312. As discussed with respect to the earlier embodiment, the lower outer wall flange 339 of the base 312 has an outside dimension to fit within an SBS formatted nest in order to facilitate use with automated or semi-automated pipetting equipment.

The peripheral flange 332 of the liner 214 also includes cut outs having a shape and location corresponding to the cut outs 338 on the lid 315. The cut outs in the peripheral flange 332 of the liner 214 allow the flange of the liner to be placed flat on the top of the wall of the reusable base 312. The locking mechanisms 317 can be slid into the locking position, when the lid 315 is not in place, in order to hold the liner 214 flat in the reusable base 312. Keeping the bottom of the liner 214 flat reduces the retained volume of liquid after attempting to fully aspirate all the liquid from the liner 214 with a 96 or 384 pipetting head.

Figure 13:
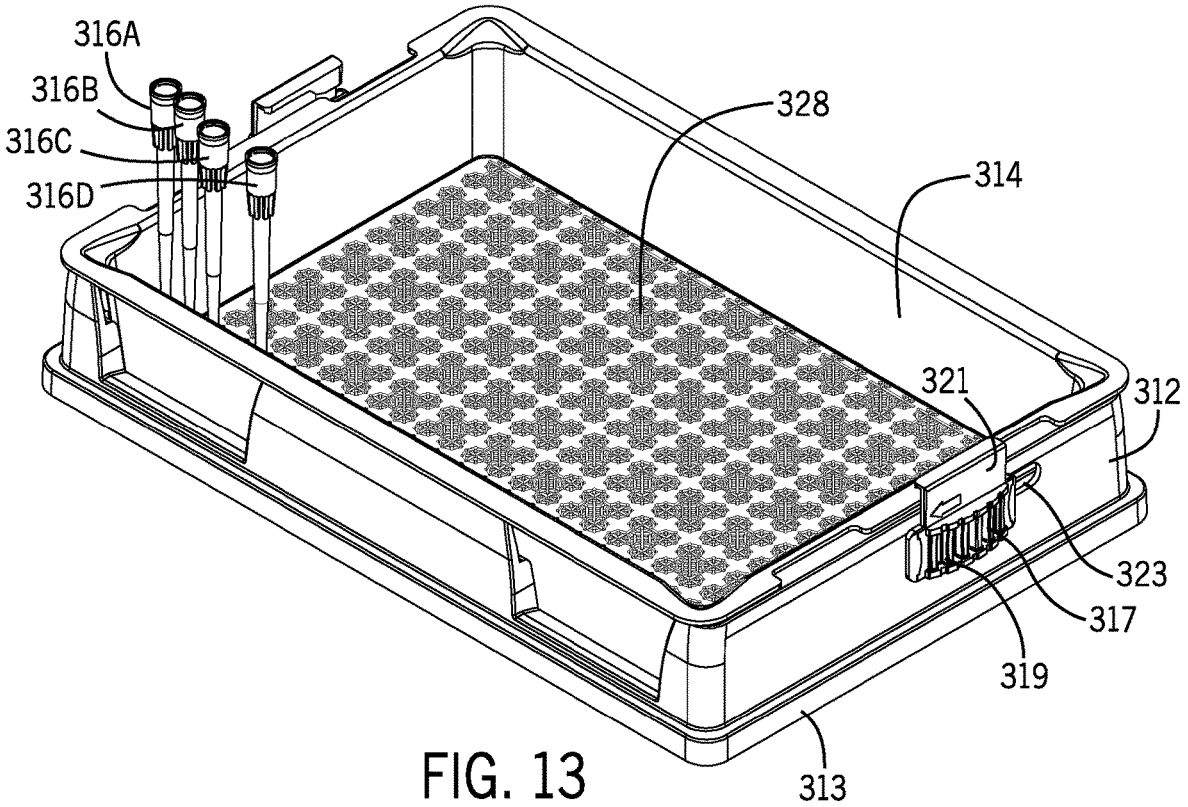
FIG. 13 is a perspective view of the kit with the lid removed showing use with pipette tips.
Figure 14:
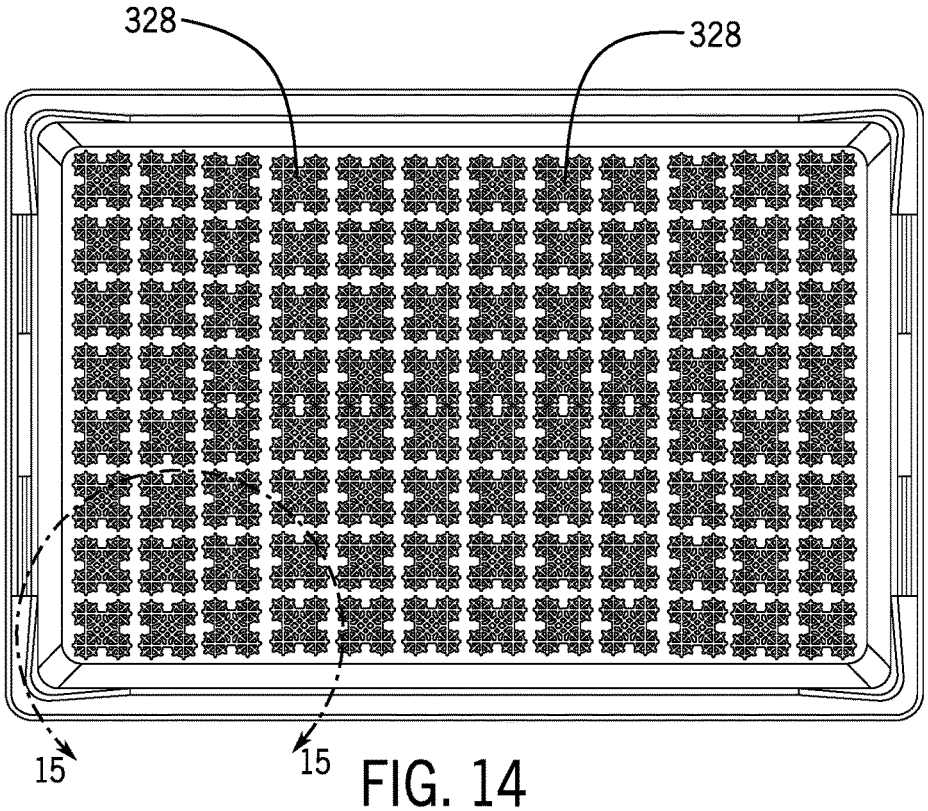
FIG. 14 is a top plan view of the laboratory reservoir kit shown in FIGS. 9 through 21 with the lid removed in order to show the liner and the anti-vacuum channels on the bottom wall of the liner.
Figure 15:
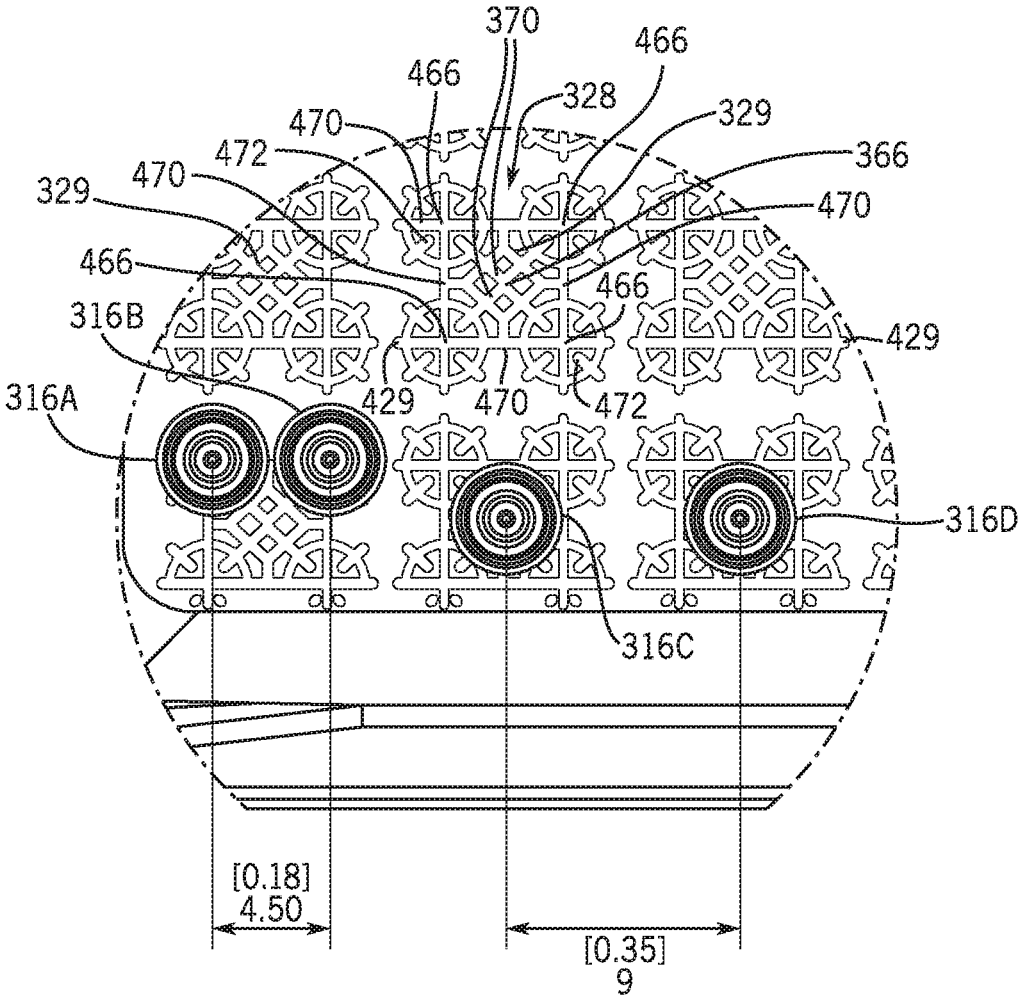
FIG. 15 is a detailed view of the region depicted by line 15-15 in FIG. 14.

Referring now to FIGS. 13 through 15, the liner 314 contains groupings 328 of anti-vacuum channels designed to accommodate both a 96 pipetting head and a 384 pipetting head. FIGS. 13 and 15 show exemplary pipette tips 316A, 316B, 316C, 316D. The pipette tips 316A and 316B represent tips on a 384 head and are spaced apart at 4.5 mm centerline spacing. The pipette tips 316C and 316D represent tips on a 96 head and are spaced apart at 9 mm centerline spacing.

In this embodiment, some of the anti-vacuum channels are shared between groupings 329 for the 96 pipetting head and the groupings 429 for the 384 pipetting head. FIG. 15 shows the groupings 329, 429 in detail. The groupings labeled 329 for the 96 head includes intersecting linear channels 370. The anti-vacuum channels 370 extend beyond the area in which they are expected to be used for pipette tips on a 96 head and are part of the groupings 429 of anti-vacuum channels used for a 384 head. The 384 head groupings 429 include horizontal and vertical channels 470 and diagonal channels 472 in addition to a circular channel. The center points of the 384 head groupings are designated by referenced number 466 and the distance between adjacent center points for 384 head groupings is 4.5 mm as depicted in FIG. 3. The center points for 96 head groupings is designated by reference number 366 and the distance between center points 366 for adjacent 96 head groupings 329 is 9 mm as also depicted in FIG. 15. In this embodiment, all the channels have a width of 0.50 mm+/−0.10 mm (constant width accounting for draft angle is desired) and a constant depth of 0.3 mm+/−0.1 mm.

Although not illustrated in the embodiments shown in Figures, additional channels can be optionally located between adjacent groupings to fluid dynamically connect adjacent groupings of anti-vacuum channels. Some or all of the groupings can be fluid dynamically connected directly or indirectly in this manner. The capillary action tends to even fluid distribution among the connected channels, which can in turn reduce the minimum working volume for reliable pipetting with multiple pipette tips.

As described above, the liner 314 is desirably made of a molded transparent plastic, in part so that graduation marks (not shown) on the inside surface of the sidewall of the base 314 can be read by the user, as described with respect to the embodiment disclosed in FIGS. 1 through 8. In one desired embodiment, the liner 314 is made from molded polystyrene or polypropylene and is corona treated or otherwise treated so that the bottom wall of the plastic liner has increased wettability compared to the bottom wall of the polystyrene liner before corona treatment, and desirably so that the surface tension of the bottom wall of the liner is greater than or equal to about 72 dynes/cm which is the surface tension of natural water. It has been found that this treatment along with the use in the above illustrated reservoir kit 310, as shown in FIGS. 9 through 15, is especially effective at minimizing dead volume or residual volume. Dead volume can vary on a number of factors including the type of liquid being pipetted. The measured dead volume of water using 384 12.5 ml tips for the embodiment shown in FIGS. 9 through 15 with corona treated polystyrene liners 314 can be less than 3 ml. This is measured in accordance with the common practice stopping an aspiration cycle in a multi-channel pipette as soon as one of the tips aspirates air. Then, reversing the direction of the pipette until liquid is dispensed from all of the tips, including the tip aspirating air, so that an equal volume of liquid is in each tip. The tips are also touched off to release any additional liquid. Of course, minimizing dead volume or the required minimum working volume may be a secondary goal in certain applications, yet the invention is still useful to eliminate the potential of the pipette tip vacuum engaging with the bottom wall of the liner.

The present invention is not limited to the exemplary embodiments described above so long as it is covered by the subject matter of the claims that follow.

What is claimed is:

1. A disposable reservoir liner configured to be seated in a reusable reservoir base, the disposable liner comprising: a basin including a pair of end walls, a pair of longitudinal side walls extending between the end walls and a flat bottom wall spanning between the lower end of the end walls and the lower end of the side walls, the flat bottom wall having an upper surface with multiple groupings of interconnected anti-vacuum channels exposed upwardly towards a volume in which a liquid sample or liquid reagent is held, wherein the flat bottom wall further has a generally rectangular shape configured to enable a matrix of pipette tips to aspirate liquid from the basin contemporaneously.

2. A laboratory reservoir kit for holding liquid samples or liquid reagents comprising the disposable liner of claim 1, and a reusable reservoir base for holding the disposable liner.

3. The laboratory reservoir kit as recited in claim 2 wherein the reusable base has an outside wall flange dimensioned to fit in nests configured to hold SBS formatted well plates and reservoirs.

4. The disposable reservoir liner recited in claim 1 wherein the bottom wall of the liner contains a matrix of 96 groupings of interconnected anti-vacuum channels with a center point for each grouping spaced 9 mm from the center point of adjacent groupings.

5. The disposable reservoir liner recited in claim 1 wherein the bottom wall of the liner contains a matrix of 384 groupings of interconnected anti-vacuum channels with a center point for each grouping spaced 4.5 mm from the center point of adjacent groupings.

6. The disposable reservoir liner recited in claim 1 when the bottom wall of the liner contains a matrix of 96 groupings of interconnected anti-vacuum channels with a center point for each grouping spaced 9 mm from the center point of adjacent 96 groupings and the bottom wall of the liner also contains a matrix of 384 groupings of interconnected anti-vacuum channels with a center point for each grouping spaced 4.5 mm from center point of adjacent 384 groupings, wherein each of the 96 groupings of interconnected anti-vacuum channels shares one or more channels with 4 groupings of 384 interconnected anti-vacuum channels.

7. The disposable reservoir liner recited in claim 1 wherein the channels have a width of 0.50 mm+/−0.10 mm and a constant depth of 0.30 mm+/−0.10 mm.

8. The disposable reservoir liner recited in claim 1 wherein groupings of interconnected anti-vacuum channels on the bottom wall of the liner contain a first pair of perpendicular and intersecting channels with the intersection of the channels defining a center point for the grouping, and a second pair of perpendicular channels rotated 45° from the first pair, said second pair of channels being aligned to intersect at said center point but interrupted in the vicinity of the center point.

9. The disposable reservoir liner recited in claim 8 wherein the groupings of interconnected anti-vacuum channels with said second pair interrupted in the vicinity of the center point further comprises a circular channel intersecting with each of the channels of the first and second pair.

10. The disposable reservoir liner recited in claim 1 wherein the flat bottom wall of the liner contains groupings of interconnected anti-vacuum channels corresponding to the location of each pipette tip in the matrix of pipette tips and no channels extend between adjacent groupings of anti-vacuum channels.

11. The disposable reservoir liner recited in claim 1 wherein the disposable liner is transparent.

12. The disposable reservoir liner recited in claim 1 wherein the liner is made from one of molded polystyrene or molded polypropylene and the liner is treated so that the bottom wall of the liner has increased wettability compared to the bottom wall of the liner before treatment.

13. The disposable reservoir liner recited in claim 1 wherein the measured surface tension of the bottom wall of the liner is greater than or equal to about 72 dynes/cm.

14. The laboratory reservoir kit in claim 2 wherein the reusable reservoir base has a pair of end walls and a pair of longitudinal side walls between the end walls and a bottom wall spanning between the end walls and the longitudinal side walls, and the liner is configured to fit in the base so that the base provides stable support for the disposable liner with the bottom wall of the liner sitting on the reservoir base; and further wherein:

at least one of the side walls on the reusable reservoir base has distinct liquid volume graduation marks on a surface of the side wall forming a portion of the basin; and the disposable liner is made of transparent plastic material and has a shape that closely follows a contour of the basin of the reusable base; and further wherein the liquid volume graduation marks on the side wall of the basin are calibrated to measure a volume of liquid sample contained in the disposable liner and are observable when the disposable liner is set in place within the reusable base.

15. The laboratory reservoir kit in claim 2 wherein the disposable liner further comprises a peripheral flange that extends outward from a top of the liner basin; and the laboratory reservoir kit further comprises a removable lid and a locking mechanism on the reusable reservoir base the locks the lid to the base with the peripheral flange of the liner there between, said peripheral flange having a cutout to provide clearance around the locking mechanism on the reusable reservoir base when the locking mechanism is in an unlocked position.

16. The laboratory reservoir kit recited in claim 15 wherein the removable lid is transparent and the reusable reservoir base has one or more viewing windows in one of its side walls.

17. The disposable reservoir liner recited in claim 1 wherein each groupings of interconnected anti-vacuum channels on the bottom wall of the liner contain contains at least one pair of perpendicular and intersecting channels with the intersection of the channels defining a center point for the grouping, and a peripheral channels that intersects each of the channels in the first pair.

18. The disposable reservoir liner recited in claim 1 wherein the channels have a width of no more than 0.50 mm+/−0.10 mm.

19. A kit comprising pipetting equipment with one or more pipette tip mounted on one or more fittings on the pipetting equipment and the disposable liner according to claim 1, wherein each of the groupings of interconnected anti-vacuum channels is configured to provide a fluid accessible void underneath the orifice of any of the pipette tips pressed against the bottom wall of the basin in the region of the grouping of interconnected anti-vacuum channels thereby preventing vacuum engagement of one or more pipette tips against the bottom wall of the liner basin when liquid is aspirated from the basin into the pipette tips.

* * * * *